United States Patent [19]

Niwa et al.

[11] Patent Number: 4,793,516

[45] Date of Patent: Dec. 27, 1988

[54] NESTABLE PACKAGING CONTAINER

[75] Inventors: Isao Niwa, Amagasaki; Mikio Ishimoto, Takarazuka, both of Japan

[73] Assignee: Kishimoto Sangyo Co., Ltd., Osaka, Japan

[21] Appl. No.: 936,076

[22] Filed: Nov. 28, 1986

[30] Foreign Application Priority Data

Nov. 27, 1985 [JP] Japan ..... 60-182447[U]
May 30, 1986 [JP] Japan ..... 61-83538[U]

[51] Int. Cl.[4] ..... B65D 17/32; B65D 43/16

[52] U.S. Cl. ..... 222/143; 206/519; 206/520; 215/2; 215/10; 220/335; 222/456.1; 222/541; 222/556

[58] Field of Search ..... 222/143, 531, 541, 556, 222/560, 571, 465.1; 206/519, 520, 508, 515; 215/2, 10; 220/307, 335, 339, 352, 94 A; 229/2.5 R

[56] References Cited

U.S. PATENT DOCUMENTS

| | | | |
|---|---|---|---|
| 2,932,437 | 4/1960 | Wilcox | 220/94 A X |
| 3,087,657 | 4/1963 | Eckles | 222/531 |
| 3,157,322 | 11/1964 | Bernhardt | 222/556 X |
| 3,168,222 | 2/1965 | Wanderer | 222/143 X |
| 3,655,111 | 4/1972 | Surerus | 222/541 X |
| 3,737,066 | 6/1973 | Ames | 222/143 X |
| 3,800,843 | 4/1974 | Edwards | 215/10 X |
| 3,966,080 | 6/1976 | Bittel | 222/541 X |
| 4,591,078 | 5/1986 | Weissman | 222/571 X |
| 4,669,640 | 6/1987 | Ando et al. | 222/541 |

FOREIGN PATENT DOCUMENTS

| | | | |
|---|---|---|---|
| 1038732 | 9/1958 | Fed. Rep. of Germany | 215/10 |

*Primary Examiner*—Kevin P. Shaver
*Attorney, Agent, or Firm*—Wenderoth, Lind and Ponack

[57] ABSTRACT

A packaging container for a liquid and more specifically for coffee milk has a container proper having a bottom opening and a bottom cap to seal the bottom opening of the container proper after the container is filled. The container proper having a sectional shape suitable for stacking containers in each other, a top plane having a planar dimension and shape suitable for supporting the container stably when it is turned upside down and being provided with a pouring opening having a lid with hinge action given by a light-gage hinge portion formed at one end of the lid. The lid having a vertical flange at the inside face, whose lower end is connected integrally with a peripheral edge of the pouring opening with an easily broken light-gage portion formed therebetween. The easily broken light-gage portion being provided by forming a score at a connecting portion and the deepest point of the score being positioned outwardly of an outside face of the vertical flange of the lid.

4 Claims, 4 Drawing Sheets

NESTABLE PACKAGING CONTAINER

BACKGROUND OF THE INVENTION

1. Field of the Invention

This invention relates to a packaging container, and more particularly to a packaging container for a liquid such as coffee milk which is also usable for a pouring pot by a purchaser.

2. Prior Art

There have been provided various kinds of packaging containers of this sort.

A packaging container of this sort should satisfy the following requisites. Namely, it should be able to be easily filled with a product and it should be usable for a pouring pot as it is and also it must be convenient for preserving the contents. The packaging container of the prior art does not fully satisfy the requisites.

Further, following problems have been found especially in a packaging container for coffee milk. Coffee milk to be served in a tearoom has been purchased in a large volume and poured into a number of pouring pots to be used by customers, which is troublesome and takes time. Further a number of pouring pots must be washed and cleaned after use. On the other hand, a packaging container of the one cup type has been also used for coffee milk. This is convenient for the reason that said container can be thrown away after use, but it is troublesome to pour coffee milk into each cup in a factory and besides it results in a high cost.

SUMMARY OF THE INVENTION

It is therefore an object of the present invention to provide a packaging container which can be easily filled with a liquid such as coffee milk and which is usable for a pouring pot as it is and suitable for preserving the contents for later use. More specifically, it is an object of the present invention to provide a packaging container especially for coffee milk, which can be easily filled with coffee milk, and which is usable for a pouring pot as it is without subdividing into a number of pouring pots and which can serve coffee milk again and again while keeping it clean.

In accordance with the present invention, a packaging container for a liquid content, especially for coffee milk, is composed of a container proper having a bottom opening and a bottom cap to seal the bottom opening of the container proper after the container is filled, said container proper having a sectional shape suitable for stacking on like containers, a top plane having a planar dimension and shape suitable for being stable when turned upside down and being provided with a pouring opening having a lid with hinge action provided by a light-gage hinge portion formed at one end of the lid, said lid having a vertical flange at the inside face, whose lower end is connected integrally with a peripheral edge of the pouring opening with an easily broken light-gage portion formed therebetween.

Said easily broken light-gage portion may be provided by forming a score at a connecting portion between the lower end of the vertical flange of the lid and the preipheral edge of the pouring opening, and in that case the deepest point of the score may be positioned outwardly of an outside face of the vertical flange of the lid.

The lid may further have a pair of flaps extending downwardly from the inside face of the lid at both ends near the hinge portion, said flaps having an engaging face which engages with the peripheral edge of the pouring opening when the lid is opened so that the lid is kept opened.

A packaging container in accordance with the present invention can be easily filled with a liquid such as coffee milk through the bottom opening of the container proper while the container proper is standing stably while turned upside down with the top plane having a planar dimension and shape suitable for standing up stably. After the container is filled, the bottom opening of the packaging container is hermetically sealed with the bottom cap. When used, the lid with the hinge action can be easily separated from the container proper having the light-gage hinge portion connected to the container proper at one end of the lid so that the pouring opening is formed and the lid can be opened and closed by hinge action.

The packaging container of the present invention is thus easily filled with a liquid and suitable for an automatic filling process by an automatic filler in view of the stackability and stable standing up while turned upside down. By opening the lid, the packaging container is usable for a pouring pot as it is and by closing the lid, the content can be kept clean for later use.

DESCRIPTION OF THE PREFERRED EMBODIMENT

Figure 1:
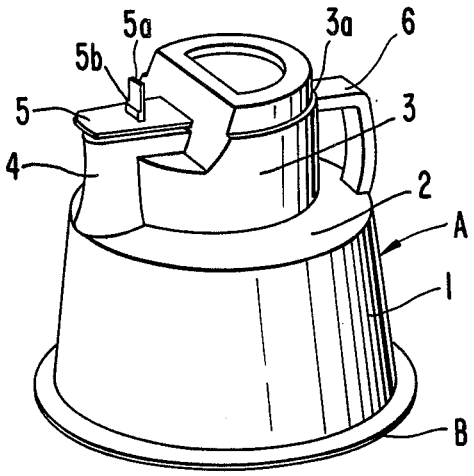
FIG. 1 is a perspective view of a packaging container showing one embodiment of the present invention.

A packaging container shown in FIG. 1 through FIG. 8 is composed of a container proper A having a bottom opening and a bottom cap B to seal the bottom opening of the container proper after the container is filled. Hermetical sealing of the bottom cap may be attained by applying heating, high frequency, supersonic vibrations or adhesives, depending on the materials used.

The container proper A is formed integrally by injection molding. Any thermoplastic resin may be used and the material to be used may be selected in accordance with a product to be filled thereinto, product life etc. In case of coffee milk, high density polyethylene is most suitable.

The bottom cap B may be also formed with any suitable material. As one example, an aluminum foil laminated with a plastic film which can be heat-bonded with the container proper is suitable.

The container proper A has a sectional shape suitable for stacking with like containers and also has a top plane means having a flat planar dimension and shape which is suitable for supporting the container stably when it is turned upside down. In this embodiment, the bottom portion has the largest diameter and the outer diameter is gradually decreased towards the upper portion. The top portion of the container proper in this embodiment has a relatively small dimension. Accordingly, in order to form a top plane means having a flat planar dimension and shape suitable for supporting the container stably when it is turned upside down, a top portion of a projection 5a formed on an outside face of a lid 5, which is explained in detail hereinafter, is positioned on the same horizontal plane as the top portion of the container proper. Namely, the planar dimension of the top portion of the container proper is substantially enlarged so as to obtain the stability when it is turned upside down.

The container proper A in this embodiment comprises a lower portion 7 of a truncated conical shape decreasing in diameter toward the top and an upper portion 3 of a small cylindrical shape which is formed from the lower portion through the medium of a shoulder portion 2. The upper portion 3 has a transformed shape with a step like cut portion at one side. Between the step like cut portion and the shoulder portion 2, a pouring portion 4 and a lid 5 are provided. In opposed relation to the pouring portion 4 on the upper portion 3, a grip portion 6 is provided. But these structural and formal constructions of the container proper A are susceptible to a number of modifications and changes.

Figure 2:
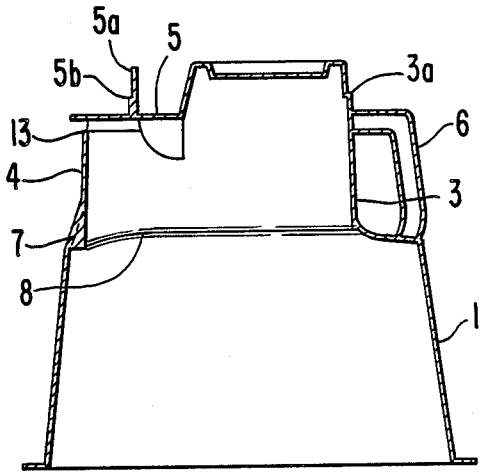
FIG. 2 is a vertical sectional view of a container proper of the same.
Figure 3:
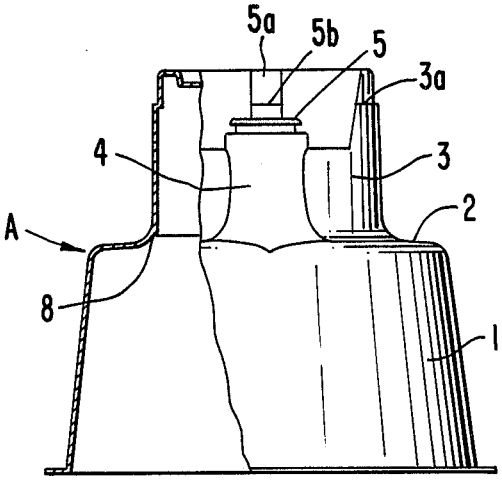
FIG. 3 is a front elevation of the same partially broken away.

As shown in FIG. 2 and FIG. 3, a rib 7 is provided at the lowest portion of an inner face of the pouring portion 4 and a projecting edge 8 is provided at the lowest portion of an inner face of the upper portion 3. When stacking the containers in each other, either a front edge of the lid 5 or an upper face of the grip portion 6 engages with the rib 7 and on the other hand a narrow step like portion 3a formed at the top of the upper portion 3 or a step like portion 5b formed on the projection 5a engages with the projecting edge 8, so that the stacking depth is controlled so that the containers will not be stacked too closely in each other and can be easily separated from each other. When the step like portion 5b of the projection 5a engages with the projecting edge 8, the upper portion of the projection 5a engages with the inner face of the upper portion 3, so that a lateral deviation of stacking can be prevented.

Figure 4:
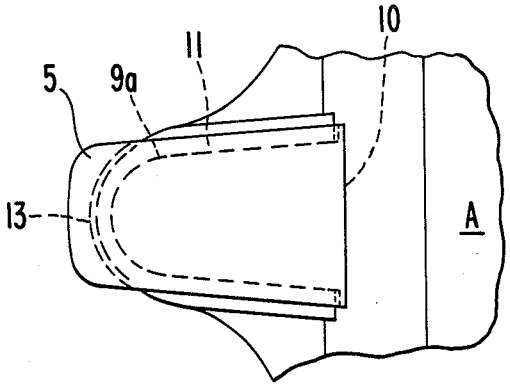
FIG. 4 is a partially enlarged plan view showing the lid portion of the same.
Figure 5:
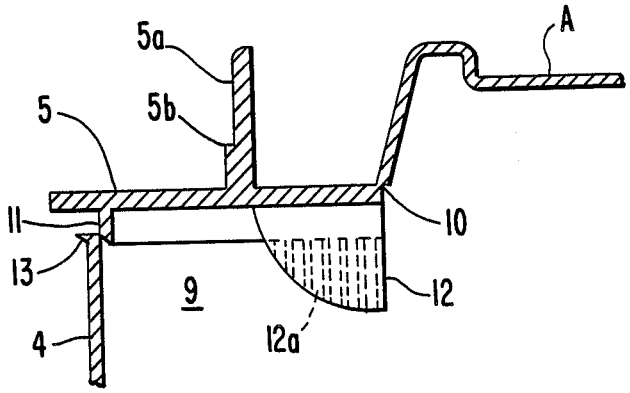
FIG. 5 is a vertical sectional view of part of the lid portion shown in FIG. 4.
Figure 6:
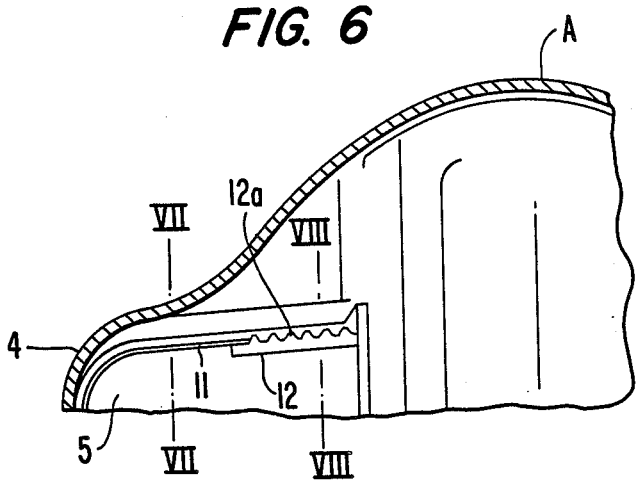
FIG. 6 is a transverse sectional view of the lid portion shown in FIG. 4.
Figure 7:
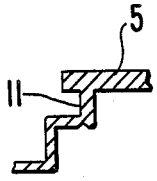
FIG. 7 is a fragmentary sectional view taken along VII—VII in FIG. 6 showing an easily broken light-gage portion.
Figure 8:
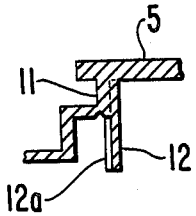
FIG. 8 is a fragmentary sectional view taken along VIII—VIII in FIG. 6 also showing an easily broken light-gage portion.

Referring to FIG. 4 to FIG. 6, the detailed structure of the lid 5 and the pouring opening 9 is shown.

In this embodiment, the lid 5 and a pouring opening 9 are provided at a top portion of the above mentioned pouring portion 4. With the exception of a hinge portion 10, the peripheral edge of the lid portion is initially formed as a light-gage portion which is joined with but can be separated easily from the container proper or the pouring portion 4 in this embodiment. Accordingly, when the light-gage portion is broken or torn off, the lid 5 and the pouring opening are simultaneously presented.

Provided at the inside face of the lid 5 is a vertical flange 11 which fits in the pouring opening 9. The peripheral light-gage portion is actually formed at a connecting portion between a lower end of the vertical flange 11 and a peripheral edge 9a of the pouring opening 9. Accordingly, the pouring opening 9 can be closed by the lid 5 and be kept clean by fitting the vertical flange 11 in the pouring opening 9 after the light-gage portion has been broken down or torn off.

Owing to the breaking down or tearing off of the light-gage portion, an irregular face is formed at the peripheral edge 9a of the pouring opening 9. Said irregular face engages with the outer face of the vertical flange 11 when the lid is closed, so that the lid will not open of itself.

Indicated by the reference numeral 12 are a pair of flaps provided at the inner face of the lid 5 at both sides in the vicinity of the hinge portion 10 and inwardly of the vertical flange 11. Said flaps have an engaging face 12a which engages with the irregular face of the peripheral edge 9a of the pouring opening 9 when the lid 5 is opened. The engaging face 12 in this embodiment is formed as vertical ribs, but many modified forms are available in which the lid will not close of itself owing to the engagement of the engaging face with the peripheral edge 9.

As shown in FIG. 4, both the pouring opening 9 and the lid 5 are given a convergent form toward the front edge, so that the engagement between the flaps 12 and the peripheral edge 9a become strong when the lid is opened. The top of the projection 5a engages with an outer face of the container proper when the lid is opened, and the opening angle is restricted by the projection 5a. The projection 5a also serves for a knob of the lid.

Figure 17:
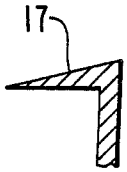
FIG. 17 and FIG. 18 are fragmentary vertical sectional views showing two embodiments of a projecting lip provided at the outside edge of a pouring opening.

Designated at 13 is a projecting lip provided at the outside edge of the pouring opening 9 by which the contents are poured with no-dripping. It may project horizontally, slightly downwardly (FIG. 17), horizontally and downwardly (FIG. 18) or in any other manner in accordance with the liquid to be filled into the container.

Figure 9:
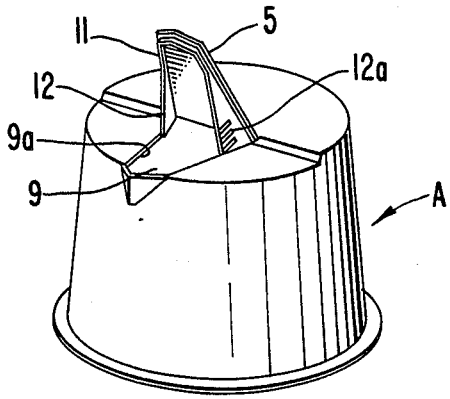
FIG. 9 is a perspective view of another embodiment of a packaging container according to the invention having the lid opened.

Shown in FIG. 9 is another embodiment of the present invention wherein a top plane means having a planar dimension and shape suitable for being supporting the container stably when it is turned upside down is provided by a top portion of the container proper A and an outer face of a lid 5. A pair of flaps 12 having a engaging face 12a are formed integrally with and extending from a vertical flange 11.

Figure 10:
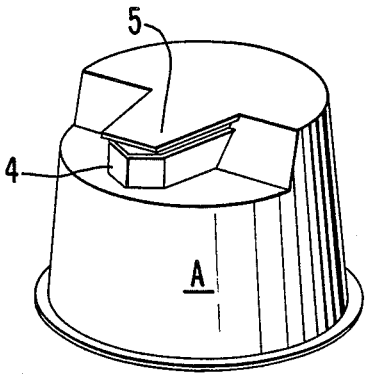
FIG. 10 is a perspective view of a packaging container according to a further embodiment of the present invention, FIG. 11(*a*) is a fragmentary enlarged plan view showing another embodiment of the present invention wherein a pair of engaging means are provided to keep the lid opened, and FIG. 11(*b*) is a vertical sectional view of the same, FIG. 12(*a*) is a fragmentary enlarged plan view showing further embodiment of a pair of engaging means in accordance with the present invention, and FIG. 12(*b*) is a vertical sectional view thereof.

FIG. 10 also shows another embodiment. This embodiment differs from the embodiment shown in FIG. 9 in the provision of a pouring portion 4.

Figure 11A:
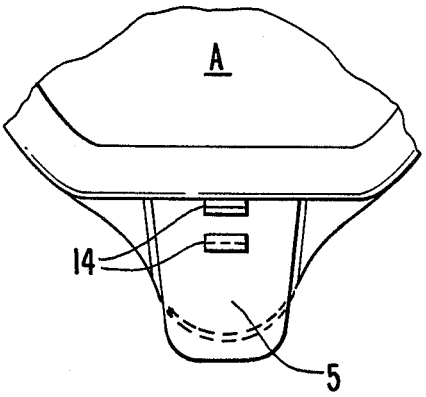
Figure 11B:
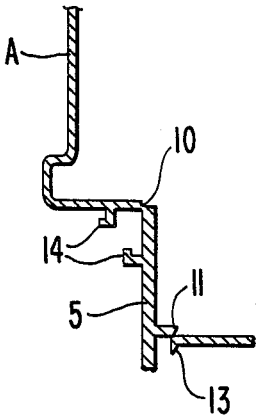
Figure 12A:
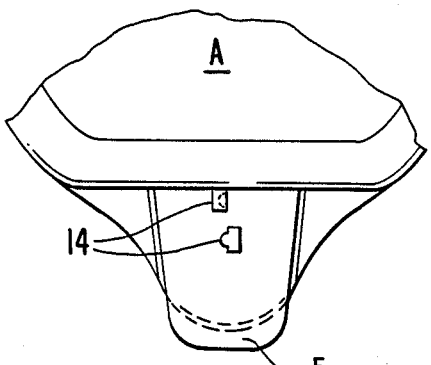
Figure 12B:
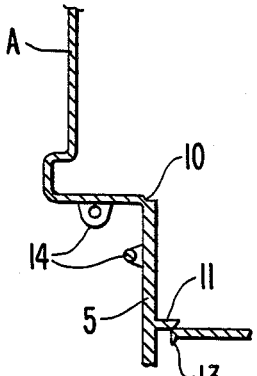
Figure 13:
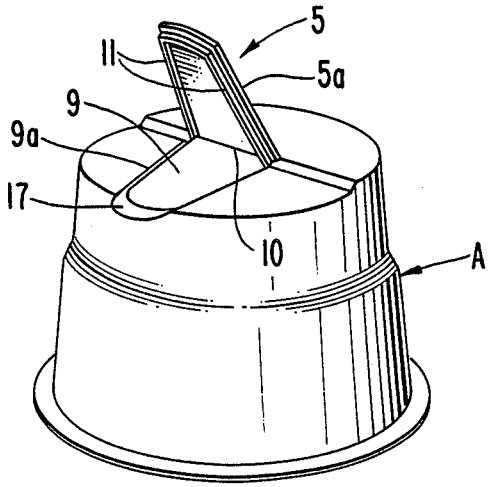
FIG. 13 is a perspective view of still another embodiment of a packaging container according to the invention having the lid opened.
Figure 14:
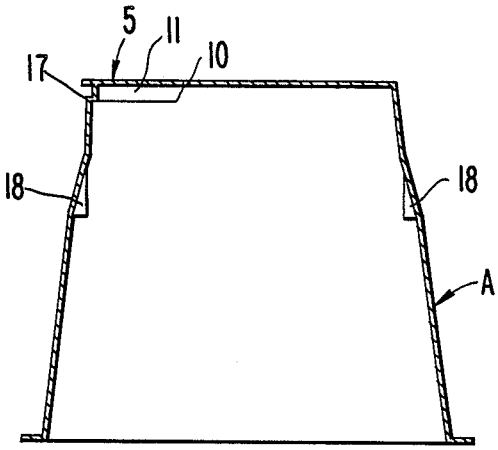
FIG. 14 is a vertical sectional view of the embodiment shown in FIG. 13 wherein the lid is closed.
Figure 15:
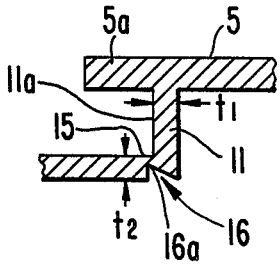
FIG. 15 and FIG. 16 are fragmentary vertical sectional views showing an easily broken light-gage portion of the same.

Shown in FIG. 11(*a*), (*b*) and FIGS. 12(*a*), (*b*) are modifications of the holding structure to keep the lid 5 opened.

Instead of a pair of flaps having an engaging face, a pair of engaging means 14 are provided respectively on an outer face of the lid and on a portion of the container proper. The lid 5 is kept opened by snap-fitting of the engaging means when the lid has opened a predetermined amount.

Instead of the engagement of the top portion 5*a* of the projection 5 with a portion of the container proper, means for restricting the degree of opening of the lid may be provided by providing a small projection on the outer face of the lid in the vicinity of the hinge portion 10 which engages with a portion of the container proper when the lid is opened.

FIG. 13 through FIG. 16 show still another embodiment of the packaging container in accordance with the present invention.

A top plane means having a planar dimension and shape suitable for supporting the container stably when it is turned upside down is provided by a top portion of the container proper A and an outer face of a lid 5. The lid 5 is so provided as to open and close at a hinge portion 10 by breaking down or tearing off an easily broken peripheral light-gage portion.

A pouring opening 9 is provided coinciding with the shape of the lid 5. The lid 5 has a vertical flange 11 at the inside face. At a connecting portion between the lower end of the vertical flange 11 and the peripheral edge 9*a* of the pouring opening 9, the above mentioned easily broken light-gage portion 15 is provided by forming a score 16 from the inside of the container proper. The deepest point 16*a* of the score 16 is positioned outwardly of the outside face 11*a* of the vertical flange 11 of the lid 5, so that the light-gage portion 15 can be easily broken down by pushing the lid.

Figure 16:
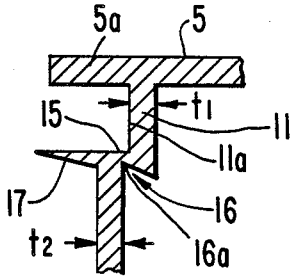
Figure 18:
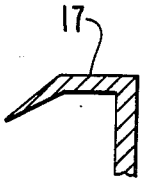

Shown by 17 is a projecting lip provided at the outside edge of the pouring opening 9 through which the contents are poured with no-dripping. Said lip 17 has a tip made as thin as possible and has a length at least of 1 mm so as to attain a good no-drip effect. Said lip may be projected horizontally as shown in FIG. 16 or may be projected slightly downwardly (FIG. 17) or otherwise may be projected first horizontally and next downwardly as shown in FIG. 18. The latter two embodiments are preferably to pour the contents with no-dripping.

A difference between the thickness t1 of the vertical flange 11 of the lid 5 and the thickness t2 of the peripheral edge of the pouring opening is preferable to make it easier to break down the light-gage portion 15. Regulating the property of a resin used, for example by mixing an inorganic filler such as titanium oxide or talc into a thermoplastic resin of an injection molding material is also preferable for an easier breaking down of the light-gage portion.

Shown at 18 is a rib for enabling easy separating of the containers stacked in each other.

In this embodiment, a lateral flange 5*a* is provided at the peripheral edge of the lid 5 to prevent the lid from falling into the pouring opening 9. Said lateral flange may be formed only at the front edge of the lid. It will enhance the productivity in view of the simplicity of the mold, because it necessitates a split mold only at the front portion including the projecting lip 17 and the lateral flange 5*a*.

We claim:

1. A packaging container for a liquid, comprising:

a container proper having an open bottom and formed of a thermoplastic resin, said container proper having a tapered shape to permit stacking like containers proper one within the other through said open bottom, said container proper having a lower portion with a truncated conical shape decreasing in diameter toward its top, an upper portion having a horizontal top and a cylindrical shape smaller than the top of said lower portion, and a shoulder portion between the top of said lower portion and the bottom of said upper portion; a pouring portion between said shoulder portion and said upper portion and a handle connected between the shoulder portion and said upper portion, said pouring portion having a pouring opening and a lid over the top of said opening having a hinge portion integrally connected at one end with said upper portion and having a vertical flange on the under face of said lid and fitting into the pouring opening when the lid is in a position closing said pouring opening, said lid and said flange having a frangible connection with a peripheral edge of said pouring opening, and said lid having a projection on its outside face and said projection having an end in the same horizontal plane as the top of said upper portion, the end of the projection forming with the top of said upper portion means for stably supporting said packaging container when it is turned upside down, and said pouring portion having a projecting lip at a front edge of said opening remote from said upper portion and over which the contents of the packaging container is to be poured; and a bottom cap sealed over the open bottom of the container proper, whereby the packaging container can be closed after it has been filled from the bottom.

2. A packaging container as claimed in claim 1 in which said frangible connection comprises a light gate portion therealong between the peripheral edge of said pouring opening and the lower end of said vertical flange.

3. A packaging container as claimed in claim 1 in which said lid has a pair of flaps extending downwardly from the under face of said lid at both sides thereof in the vicinity of said hinge portion, said flaps each having an engaging face which engages with the peripheral edge of said pouring opening when the lid is in the open position whereby the lid will remain open.

4. A packaging container as claimed in claim 1 in which said projecting lip is tapered to a tip and has a length of at least 1 mm.

* * * * *